US005761584A

United States Patent [19]

Tsuda et al.

[11] Patent Number: 5,761,584

[45] Date of Patent: Jun. 2, 1998

[54] PROCESS CARTRIDGE TONER SUPPLY CONTAINER MOUNTABLE ONTO TONER ACCOMMODATING CONTAINER AND TONER SUPPLY METHOD

[75] Inventors: Tadayuki Tsuda, Hachioji; Kazuyoshi Odagawa, Koshigaya; Atsushi Kubota, Machida; Shinichi Sasaki, Fujisawa; Isao Ikemoto; Kazunori Kobayashi, both of Kawasaki, all of Japan

[73] Assignee: Canon Kabushiki Kaisha, Japan

[21] Appl. No.: 572,123

[22] Filed: Dec. 14, 1995

[30] Foreign Application Priority Data

Dec. 16, 1994 [JP] Japan ..... 6-333629

[51] Int. Cl.[6] ..... G03G 15/08

[52] U.S. Cl. ..... 399/258; 141/364; 206/515; 399/262

[58] Field of Search ..... 399/119, 258, 399/262; 206/514, 515; 222/DIG. 1; 141/363, 364

[56] References Cited

U.S. PATENT DOCUMENTS

| | | | |
|---|---|---|---|
| 3,651,838 | 3/1972 | Albert | 141/284 |
| 4,307,763 | 12/1981 | Wang | 141/364 |
| 4,708,455 | 11/1987 | Kubota et al. | 399/111 |
| 4,984,023 | 1/1991 | Yoshida | 399/106 |
| 5,034,776 | 7/1991 | Sugiura | 399/262 |
| 5,175,070 | 12/1992 | Tanikawa et al. | 430/122 |
| 5,184,184 | 2/1993 | Hayashi et al. | 399/35 |
| 5,202,731 | 4/1993 | Tanikawa et al. | 399/270 |
| 5,272,505 | 12/1993 | Shishido et al. | 399/174 |
| 5,294,960 | 3/1994 | Nomura et al. | 399/113 |
| 5,594,535 | 1/1997 | Beaufort et al. | 399/262 |

FOREIGN PATENT DOCUMENTS

| | | |
|---|---|---|
| 0 029 918 A1 | 6/1981 | European Pat. Off. . |
| 40 11 592 A1 | 10/1990 | Germany . |
| 01241567 | 9/1989 | Japan . |
| 2186375 | 7/1990 | Japan . |
| 04042179 | 2/1992 | Japan . |

OTHER PUBLICATIONS

European Patent Office Communication, including European Search Report for European Patent Application No. 95309189.9 dated Nov. 19, 1997.

Patent Abstracts of Japan, relating to Japanese Patent Publication No. 01241567, published Sep. 26, 1989.

Patent Abstracts of Japan, relating to Japanese Patent Publication No. 04042179, published Feb. 12, 1992.

*Primary Examiner*—William J. Royer

*Attorney, Agent, or Firm*—Fitzpatrick, Cella, Harper & Scinto

[57] ABSTRACT

A toner supply container for supplying toner into a toner accommodating container for accommodating the toner usable for developing a latent image formed on an electrophotographic photosensitive member, wherein the toner accommodating container is detachably mountable relative to a main assembly of an electrophotographic image forming apparatus, including a guide portion for guiding the toner supply container into the toner accommodating container with engagement with the toner accommodating container; a first portion and a second portion which are opposed to each other; a third portion connecting one longitudinal ends of the first portion and second portion, wherein the third portion are foldable; a fourth portion connecting the other longitudinal ends of the first portion and second portion, wherein the fourth portion are foldable; a toner supply opening, provided along a longitudinal direction between the first portion and the second portion, for supplying into the toner accommodating container the toner accommodated in the toner accommodation portion U structured by the first portion, second portion, third portion and fourth portion; a sealing member for openably sealing the toner supply opening; wherein a volume of the toner accommodation portion is reduced in a direction crossing with a longitudinal direction of the first portion and the second portion by the folding of the third portion and the fourth portion.

56 Claims, 10 Drawing Sheets

PROCESS CARTRIDGE TONER SUPPLY CONTAINER MOUNTABLE ONTO TONER ACCOMMODATING CONTAINER AND TONER SUPPLY METHOD

FIELD OF THE INVENTION AND RELATED ART

The present invention relates to a process cartridge, a toner supply container and a toner supply method.

Here, the process cartridge is a cartridge which is detachably mountable to a main assembly of an image forming apparatus and which contains as an unit an electrophotographic photosensitive member and at least one of process means such as charging means, developing means, cleaning means or the like. The process cartridge is a cartridge which is detachably mountable to a main assembly of an image forming apparatus and which contains as an unit an electrophotographic photosensitive member and a process means such as charging means, developing means, cleaning means or the like. The process cartridge is a cartridge which is detachably mountable to a main assembly of an image forming apparatus and which contains as an unit an electrophotographic photosensitive member and developing means.

The electrophotographic image forming apparatus includes an electrophotographic copying machine, electrophotographic printer, word processor or the like, wherein images are formed on a recording medium.

Conventionally, in an image forming apparatus using an electrophotographic image forming process, a process cartridge type is used wherein an electrophotographic photosensitive member and process means actable on the electrophotographic photosensitive member are unified into a cartridge, and the cartridge is detachably mountable relative to a main assembly of the image forming apparatus. Using the process cartridge type, the maintenance of the device can be performed by user himself without need of calling a serviceman, and therefore, the operativity can be remarkably improved. Accordingly, the process cartridge type is widely used in the image forming apparatus.

Among such a process cartridge type, a process cartridge with which toner can be replenished is known (for example, US Pat. No. 5, 034, 776, Japanese Laid Open Patent Application No. HEI- 02-186375 or the like).

These publications disclose a process cartridge into which a plurality of toner supply containers are insertable.

These process cartridges are advantageous.

The present invention improves such cartridges, and provide further development.

SUMMARY OF THE INVENTION

Accordingly, it is a principal object of the present invention to provide a process cartridge, toner supply container and toner supply method wherein the operativity of a toner supplying operation is improved.

It is another object of the present invention to provide a process cartridge, toner supply container, and toner supply method wherein the toner can be supplied without scattering of the toner.

It is a further object of the present invention to provide a process cartridge, a toner supply container, and toner supply method, wherein a toner supply container can be accommodated in a toner accommodating container.

A further object of the present invention is to provide a process cartridge, toner supply container and toner supply method wherein after the toner is supplied, a volume reduction of the toner accommodation portion is possible in a direction crossing with the longitudinal direction.

While the invention has been described with reference to the structures disclosed herein, it is not confined to the details set forth and this application is intended to cover such modifications or changes as may come within the purposes of the improvements or the scope of the following claims.

DESCRIPTION OF THE PREFERRED EMBODIMENT

Referring to the accompanying drawings, the embodiments of the present invention will be described.

Embodiment 1

Figure 11:
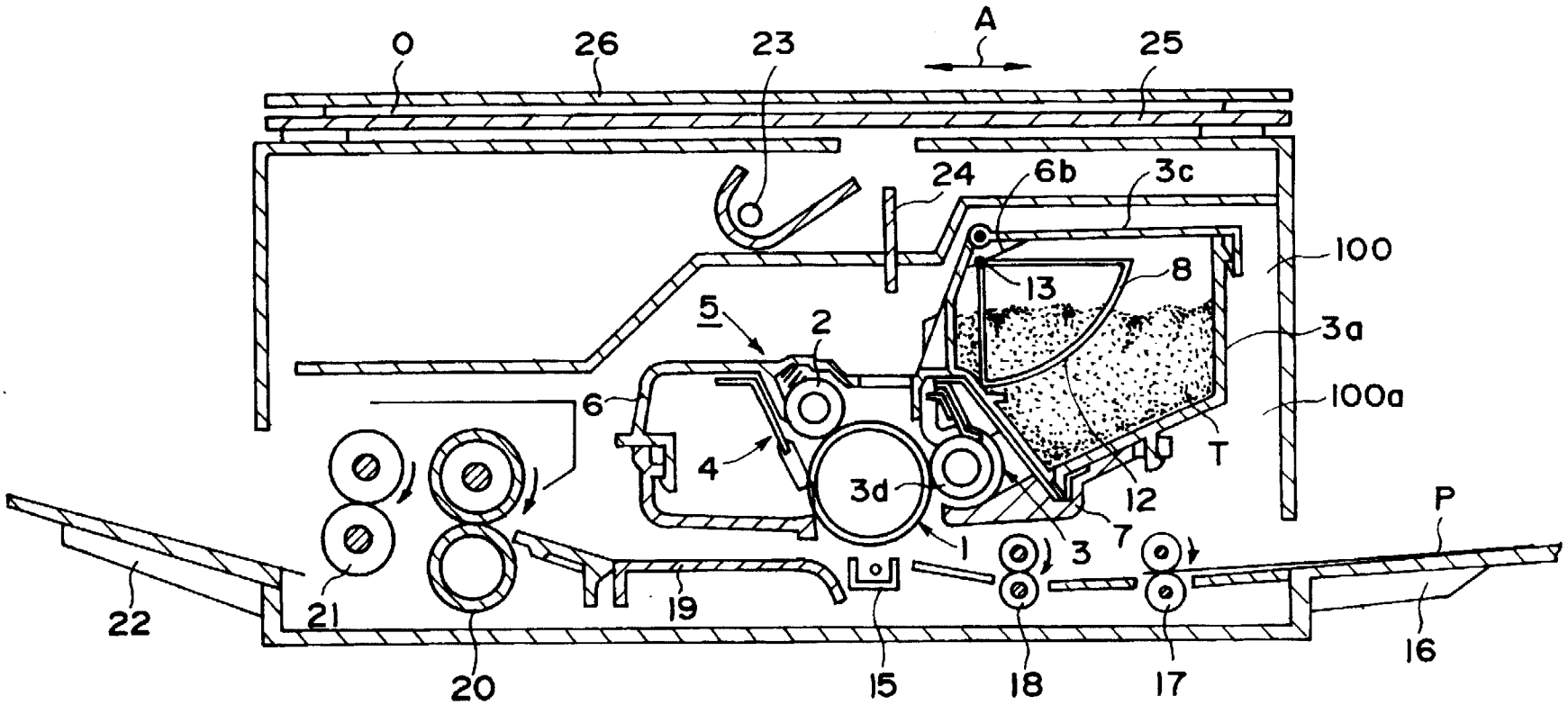
FIG. 11 shows an an embodiment of an image forming apparatus to which a process cartridge or developing device in the form of a cartridge is mountable.

Referring to FIG. 11, the description will be made as to an embodiment of an image forming apparatus 100 to which a process cartridge 5 according to the present invention is mountable.

In this embodiment, the process cartridge 5 contains process means for image formation, for example, an electrophotographic photosensitive member, and a charging means 2, developing means 3, cleaning means 4 or the like disposed around the electrophotographic photosensitive member. These means are unified by a frame of plastic resin material. The process cartridge 5 is detachably mountable relative to a main assembly of the image forming apparatus through mounting guide means (not shown).

A transfer charging means 15 is disposed in a lower portion of the main assembly of the device where the photosensitive drum 1 is located when the process cartridge 5 is mounted to the main assembly of the device 100*a*. In a sheet feeding side of the transfer charging means 15, there are disposed a sheet feeding tray 16, sheet feeding rollers 17 and registration rollers 18, and in the sheet discharge side thereof, there are disposed a paper guide 19, a fixing means 20, a sheet discharging rollers 21, and a sheet discharge tray 22.

Above the process cartridge 5, there are an illumination lamp 23 for original document illumination, and a short focus point optical element array 24 for exposure of the photosensitive drum 1 to an image light from the illumination lamp 23 and reflected by an original 0. In an upper portion of the main assembly of the device, there is an original carriage 25 movable in the direction A indicated by an arrow, and the original carriage 25 is provided with an original cover 26.

With this structure of the image forming apparatus 100, the photosensitive drum 1 is subjected to uniform charging by charging means 2, and is then exposed to the reflected image light reflected by the original O through the short focus point optical element array 24. By this, an electrostatic latent image is formed on the photosensitive drum 1 in accordance with the original document information. The electrostatic latent image is fed to a position where the photosensitive drum 1 is faced to a developing means 3 with the rotation of the photosensitive drum 1. The developing means 3 is provided with a developing sleeve **3*d* for carrying and transporting a developer (toner) T. The latent image on the photosensitive drum 1 is developed into a visualized image, namely, toner image by the toner being supplied from the developing sleeve 3*d* to the photosensitive drum 1**.

On the other hand, a recording medium P such as transfer sheet is fed from a sheet feeding tray 16 constituting the transporting means through sheet feeding rollers 17 to registration rollers 18, and is further fed to between the photosensitive drum 1 and the transfer charging means 15 by the registration rollers 18 in timed relation with the image on the drum. The transfer charging means 15 transfers the toner image from the photosensitive drum 1 onto the transfer sheet P.

The transfer sheet P carrying the toner image is fed to the fixing means 20 where the toner image thereon is fixed into a permanent image, and then, it is discharged and stacked on a sheet discharge tray 22 by the sheet discharging rollers 21.

The photosensitive drum 1 after the image transfer, is cleaned by the cleaning means 9, so that the remaining toner is removed therefrom so that it is prepared for the next image forming operation.

The description will be made as to a process cartridge 5 according to an embodiment of the present invention.

Figure 1:
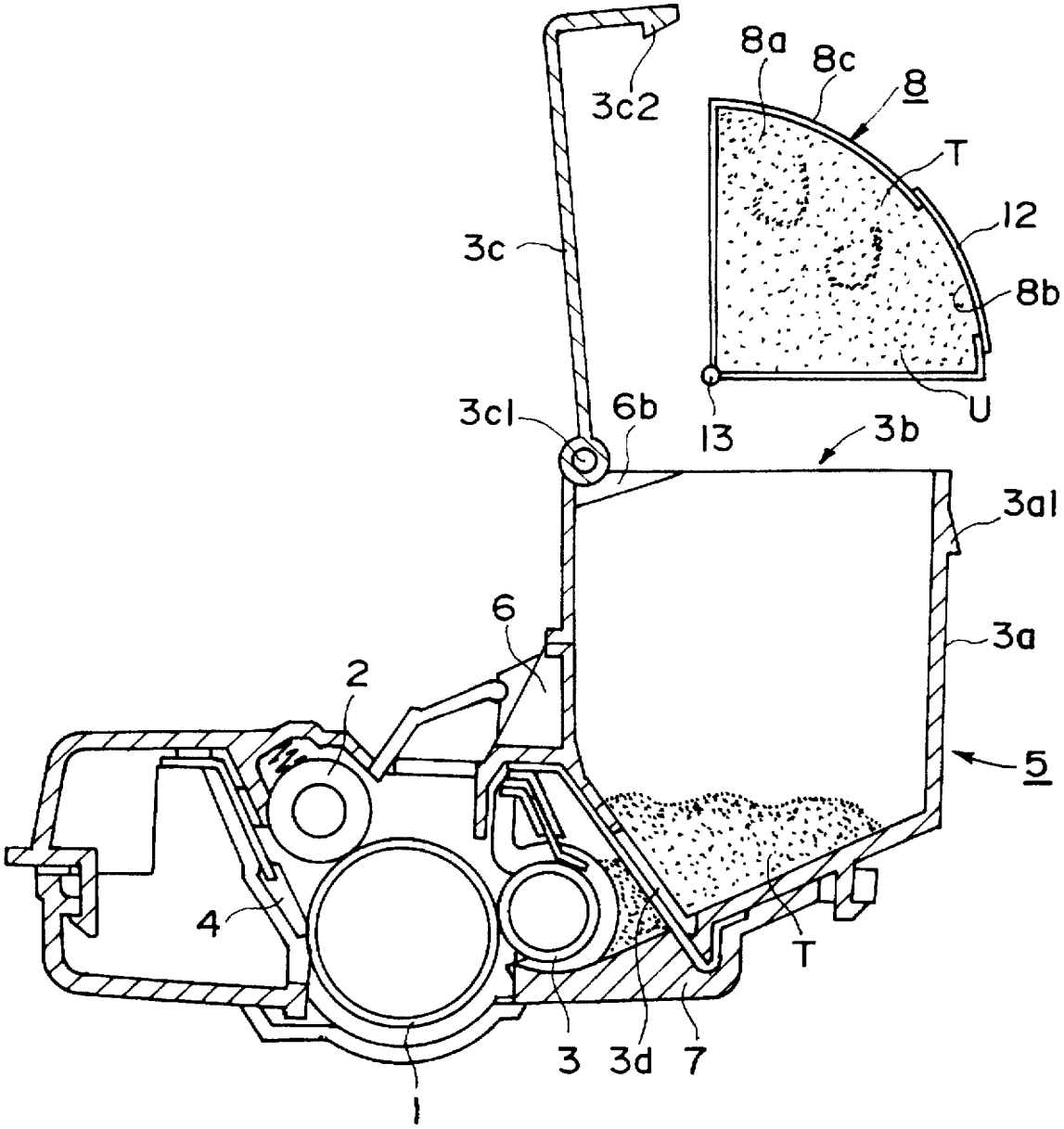
FIG. 1 is a schematic illustration of a process cartridge and a developer supply container according to embodiment 1.
Figure 2:
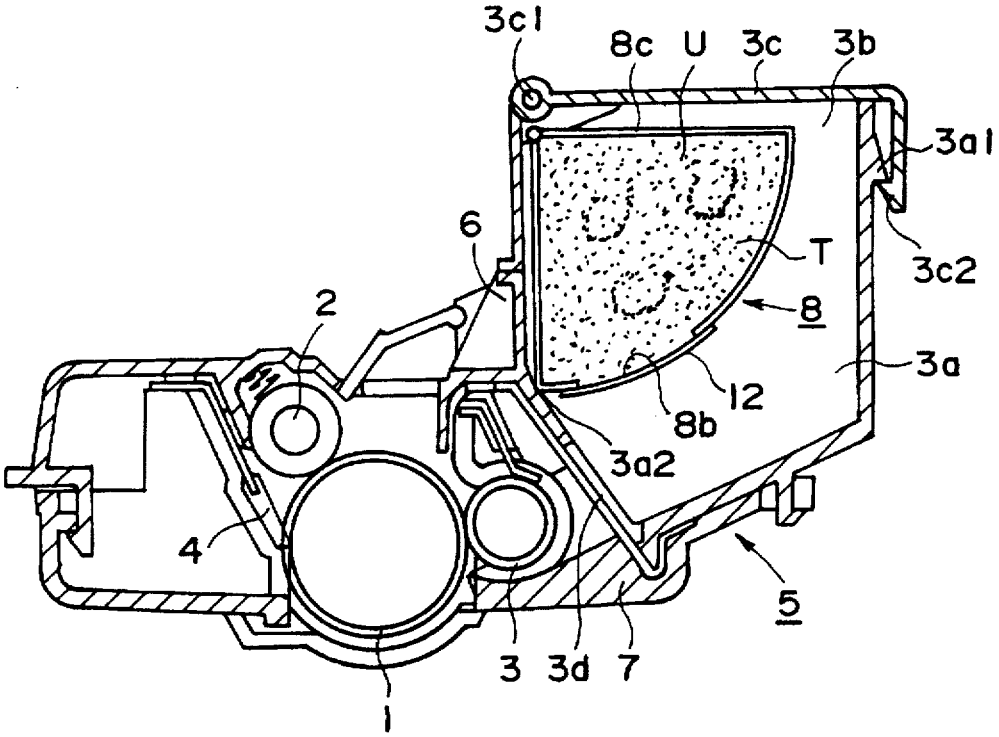
FIG. 2 is a schematic illustration of the process cartridge of FIG. 1 when it is loaded with a developer supply container.
Figure 3:
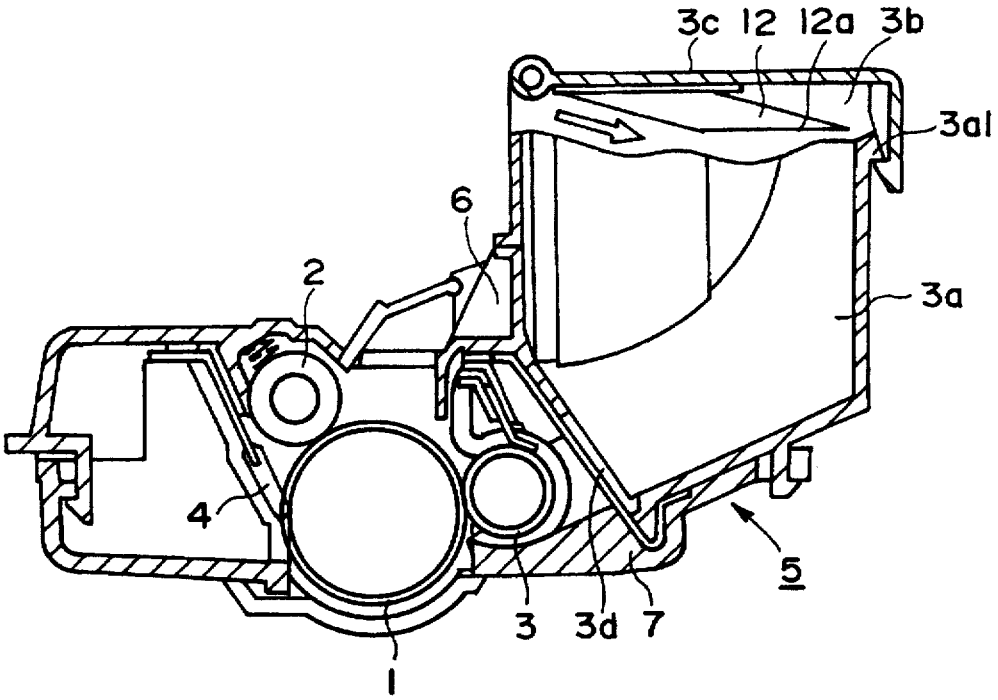
FIG. 3 is an illustration in the state of FIG. 2 wherein a seal of the developer supply container is removed to supply the toner.

FIGS. 1 through 3 show details of the process cartridge 5 described above. In this embodiment, the process cartridge 5 contains a drumlike electrophotographic photosensitive member namely a photosensitive drum 1 and at least one process means.

The process means include, for example, charging means 2 for charging the surface of the photosensitive drum 1, developing means 3 for forming a toner image on the photosensitive drum 1, cleaning means 4 for removing the toner remaining on the surface of the photosensitive drum 1. As shown in FIG. 1, the process cartridge of this embodiment comprising the photosensitive drum 1, a charging means 2, developing means 3 accommodating toner (developer) and cleaning means 4 which are around the photosensitive drum 1 and a frames 6 and 7 constituting a housing covering them. The cartridge 5 is detachably mountable relative to the main assembly **100*a*** of the image forming apparatus as an unit.

The developing means 3 will be described. The developing means 3 comprises a toner container (toner accommodating container) **3*a* for accommodating the toner, and it has an opening 3*b* at the upper portion. The opening 3*b* is normally closed by a toner container cap 3*c*. The cap 3*c* is rotatable about a shaft 3*c*1, and a leading edge 3*c*2 thereof is engaged with a dowel 3*a*1 of an outer wall of the container 3*a***, by which the opening is closed.

The toner supply container 8 has a substantially triangle column configuration close to a sector-shaped in the cross-section to permit effective using of the limited space of the toner container **3*a*. The toner accommodating portion 8*a* contains the toner T, and an opening 8*b* formed in a part of the arcuated portion 8*c* is closed with a seal 12. An outside wall of the toner supply container 8 is provided with an engaging portion 13 for mounting thereof to the cartridge. The frame 6 of the process cartridge 5 is provided with a groove 6*b* for engagement with the engaging portion 13 of the toner supply container 8**.

The description will be made as to a method of the toner supply into the cartridge 5 by the operator, when the toner contained at the beginning in the toner container **3*a* of the cartridge 5** is used up.

First, the operator opens the toner container cap **3*c* of the cartridge 5 to expose the opening 3*b* of the toner container 3*a*. Subsequently, the engaging portion 13 of the toner supply container 8 is engaged with the groove 6*b* of the toner container 3*a*, and the it is mounted into the toner container 3*a* of the cartridge while the toner supply container 8 is rotated about the engaging portion 13. As shown in FIG. 2, the toner supply container 8 is supported by the groove 6*b* and a part of of the internal wall 3*a*2 of the toner container 3*a* while the opening 8*b*** faces down.

As shown in FIG. 3, then, the operator closes the toner container cap **3*c* while the end portion of the seal 12 is outside the toner container 3*a* namely outside the process cartridge 5. By the operator pulling the end portion 12*a* of the seal 12 in the direction indicated by the arrow, the opening 8*b* of the supply container 8 is opened so that the toner accommodated is supplied into the toner container 3*a***.

As shown in FIG. 3, the one end portion **12*a* of the seal 12 is projected to outside of the cartridge 5 through a cutting away portion formed in the upper portion of the toner container 3*a***.

As will be understood from FIG. 1, the toner container **3*a* of the process cartridge 5 in this embodiment, is such that the opening 3*b* and the toner container cap 3*c* are at top positions of the toner container 3*a*, and the opening 3*b* opens upwardly so that the supply container 8 is loaded by letting it fall from the top into the toner container 3*a***.

Since the opening **3*b* is at the topmost position of the toner container 3*a*** in this manner, the toner leakage, toner overflow and the scattering can be effectively prevented as compared with the case wherein the opening is provided in a side.

If the toner container **3*a* of a fresh cartridge is filled with the toner, and the opening 3*d* is sealed by a sealing material (unshown) in the form of a film-like, for example, the first toner filling into a fresh cartridge is not necessary. Then, after the toner contained in the fresh cartridge 5 is used up, the supply container 8 is mounted from the upper portion of the cartridge 5** through the above-described process as the first toner supplying operation.

As described above, according to this embodiment, the toner can be supplied without requiring a large space for mounting the toner supply container 8 and without the scattering of the toner.

Embodiment 2

Figure 4:
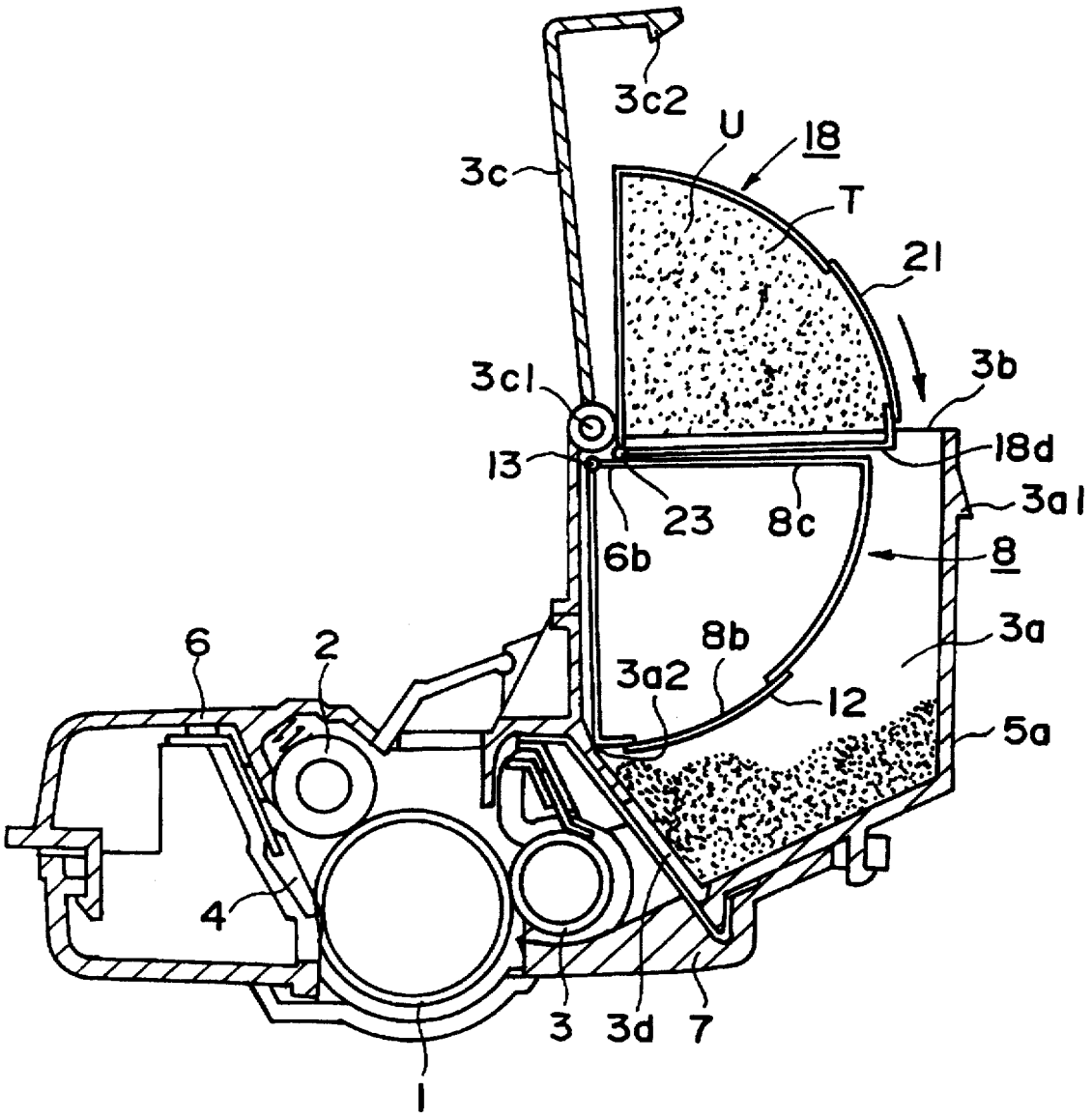
FIG. 4 is a schematic illustration of a process cartridge and a developer supply container according to embodiment 2 upon toner supply.
Figure 5:
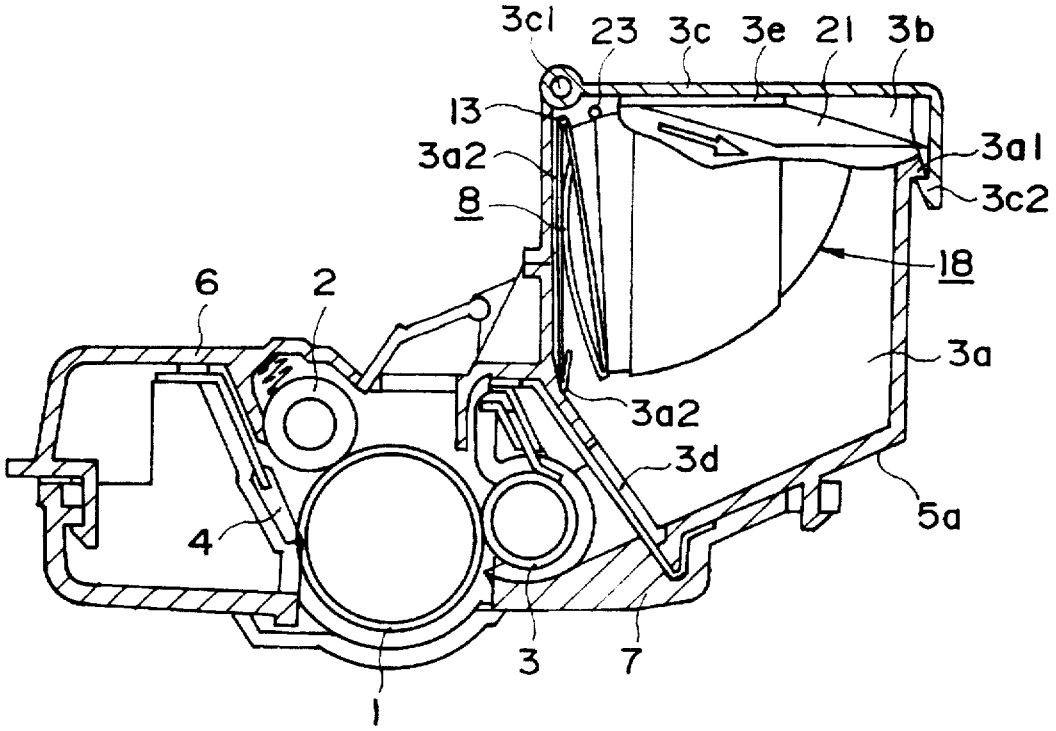
FIG. 5 is an illustration of toner supply after a seal is removed from the developer supply container of FIG. 2.
Figure 6:
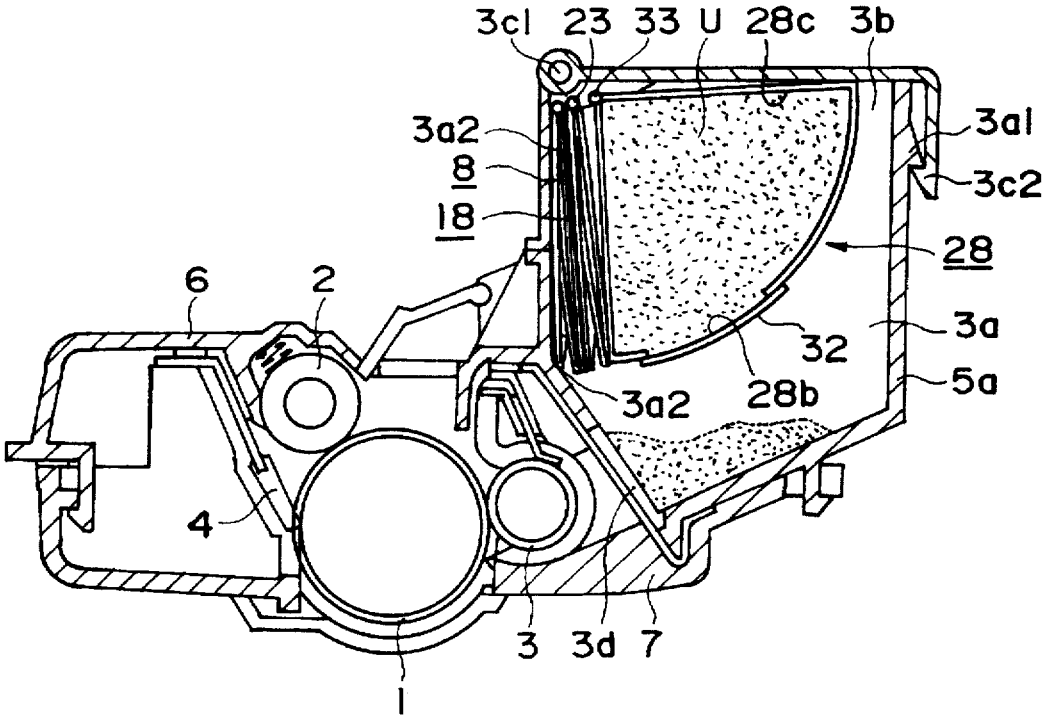
FIG. 6 is an illustration of a plurality of toner supply operations in embodiment 2.

Referring to FIG. 4 to FIG. 6, a process cartridge according to embodiment 2 will be described. The process cartridge 5*a* and the toner supply container 18 according to this embodiment are quite the same as those of FIG. 1, and the description will be made as to the different portion only.

In this embodiment, after the toner supplied by the toner supply container 8 in embodiment 1 is used up, toner is further supplied into the cartridge 5.

As shown in FIG. 4, the toner container cap 3*c* is first opened to expose the top side of the toner supply container 8 from which the loaded toner has been used up. Subsequently, the engaging portion 23 of the fresh toner supply container 18 is engaged with the groove 6*b*. The groove 6*b* has already been engaged with the engaging portion 13 of the already loaded supply container 8, but the groove 6*b* is so larger than the engaging portion 13 that it can be engaged with the engaging portion 23 of the fresh supply container 18.

As shown in FIG. 4, the toner container cap 3*c* is closed while a flat surface of the fresh toner supply container 18 is placed on the top side 8*c*. Then, by the contact with the lower surface 18*d* of the fresh toner supply container 18, the top side 8*c* of the loaded toner supply container 8 is further moved in the rotational direction (clock direction). The toner supply container 8 does not have the seal 12, and the toner T therein has been consumed, so that it is easily compressed. The supply container 8 is caused collide by the supply container 18 while the vertical surface is abutted to the internal wall surface of the toner container.

As shown in FIG. 5, the operator completely closes the toner container cap 3*c* while leaving the end portion of the seal 21 of the toner supply container 18 outside of the toner container 3*a*. Then, the operator pulls the end portion of the seal 21 in the direction of the arrow to open the opening of the fresh toner supply container 18 to permit the supply of the toner T into the toner container 3*a*.

Similarly, as shown in FIG. 6, the toner is supplied by a fresh toner supply container 28 repeatedly until the lifetime of the process cartridge 5*a* ends. Designated by 33 is an engaging portion; 28*b* is an opening; 28*c* is a top surface; and 32 is a seal.

Figure 7:
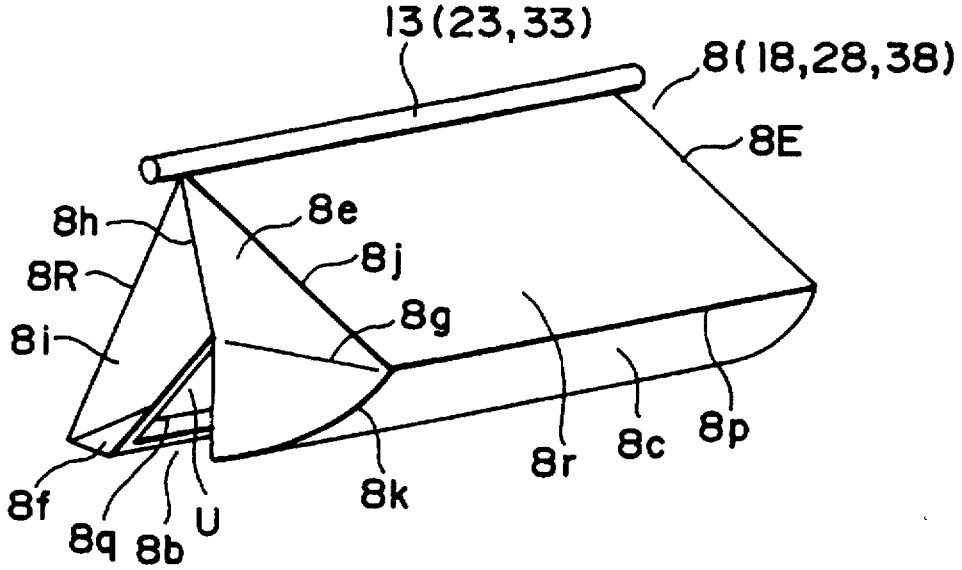
FIG. 7 illustrates a developer supply container.
Figure 8:
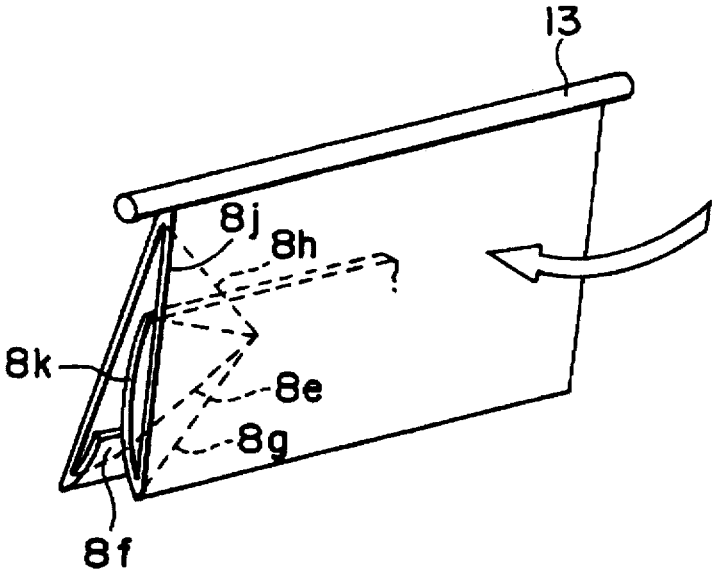
FIG. 8 is an illustration of a developer supply container of FIG. 7 when it is compressed.

Referring to FIGS. 7 and 8 the description will be made as to an embodiment of compression structure of the toner supply container 8.

FIG. 7 is a perspective view of a supply container 8 after the seal 21 has been removed. The supply container 8 has a substantially triangle column configuration close to a sector-shape in the section, the engaging portion 13 functioning as a pivot upon loading is disposed adjacent the apex (center of circular circumference curve) of the sector configuration. From the engaging portion 13, two edges 8*i* and 8*j* extend, and a wall 8*e* is formed along an arcuated portion 8*k* connecting the edges 8*i* and 8*j*. The arcuated portion 8*k* is provided with an opening 8*b* sealed by a seal 21. Edges 8*p* and 8*q* extend from an intersection between the edges 8*i*, 8*j* and the arcuated portion 8*k* in parallel with the engaging portion 13 to the wall surface 8E faced to the wall 8*e* to provide a substantially triangle column configuration.

The wall 8*e* is provided with thin lines 8*f*, 8*g* and 8*h* provided by recess of concave configurations, which function as folding lines upon compression of the supply container 8. The same folding lines are formed on the opposite wall 8E (not shown).

The container configuration of the toner supply container 8 is determined on the basis of configuration of the space of the developing container or the like allottable to the rotation mounting with the lengths of the edges 8*i* and 8*j* about the engaging portion 13. For the purpose of effective using of the limited space of the developing container 3*a*, the substantially triangle column configuration similar to the sector-shape configuration in the section is employed.

The material of the toner supply container is preferably paper or plastic resin material in the form of a film or thin plate configuration. It is formed by bonding, welding or the like. It may be formed by integral molding through blow molding or the like.

When the seal 12 of the toner supply container is not removed, namely, when the toner supply container is not used, the toner T is filled therein. By the existence of the toner and the sealing, the container is not easily compressed, and maintains its shape. After the seal 12 is removed and the toner is consumed, the container is easily foldable upon the force applied in the direction of the arrow, as shown in FIG. 8, along the thin lines 8*h*, 8*g* and 8*f*(front and back sides) and edges 8*j*, 8*i*, 8*k*, 8*p*, 8*q* with or without part cracking of the folding line.

The similar compression is accomplished by using a material such as a thin moldable resin material bladder or the like or a thin paper bag which can be easily collapsed without formation of the folding line.

In this manner, a plurality of toner supply containers can be mounted into the developer accommodating portion of the process cartridge, so that the process cartridge can be replenished with toner without scattering of the toner, without the necessity of large space. The supply container mounted in the process cartridge can be collected with the process cartridge since the it is not removed from the process cartridge after the process cartridge is exchanged.

Embodiment 3

Figure 9:
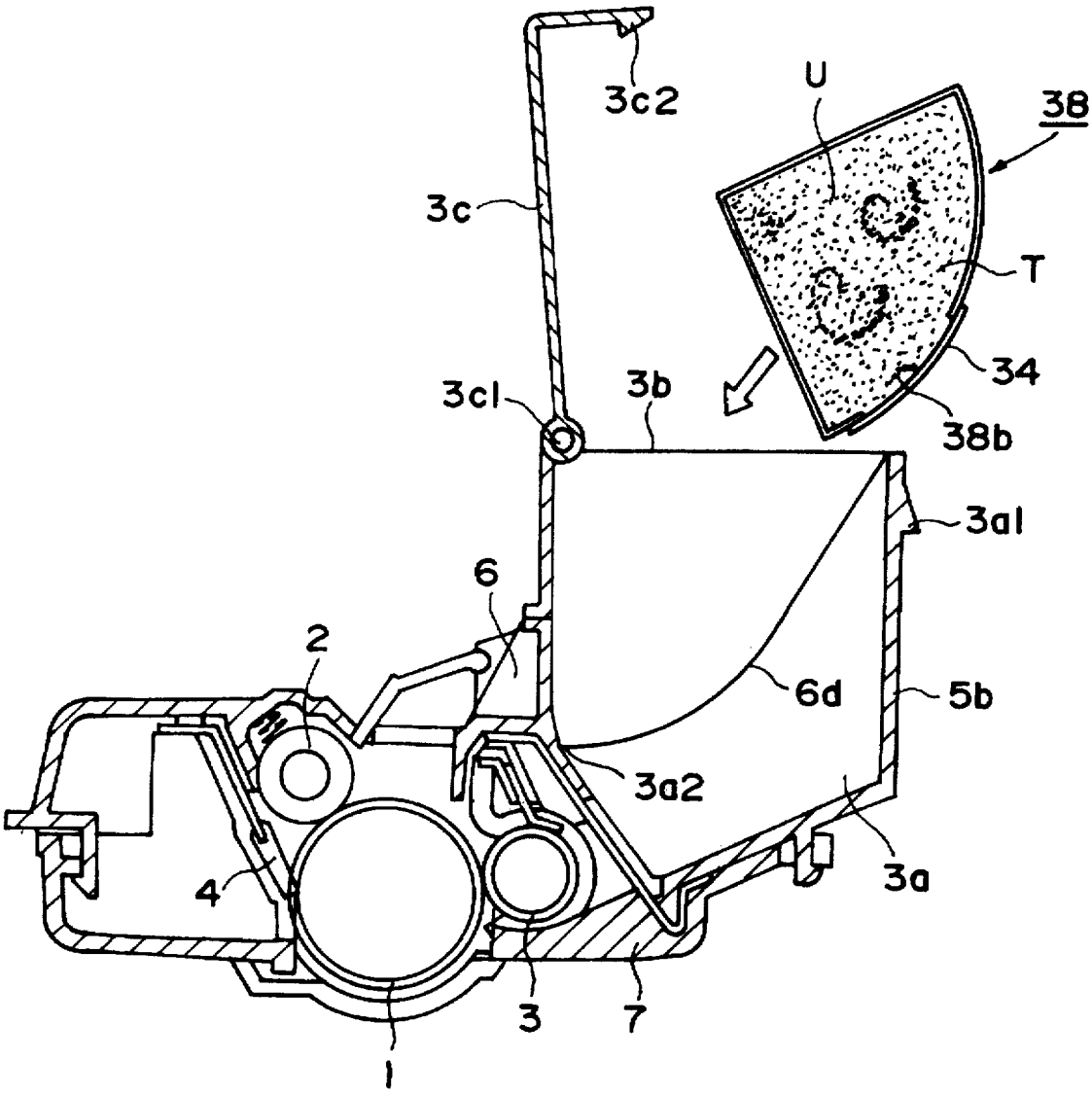
FIG. 9 is an illustration of a process cartridge and developer supply container according to embodiment 3.
Figure 10:
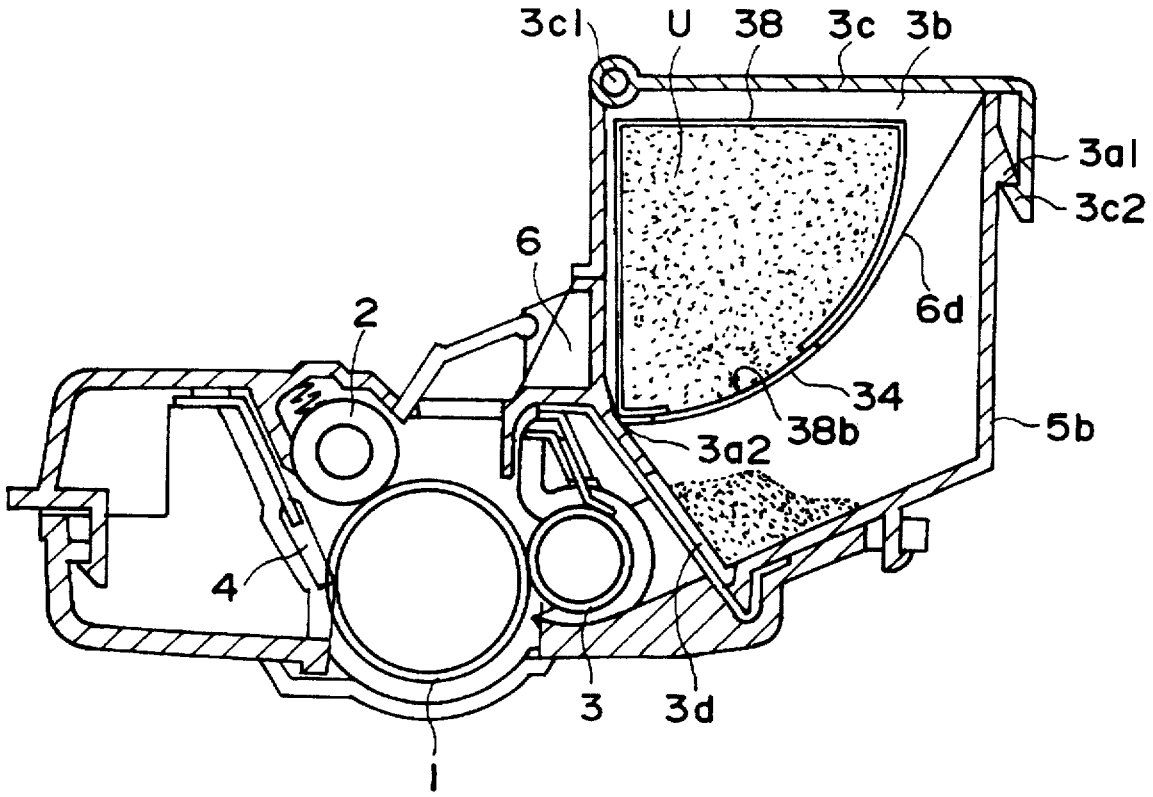
FIG. 10 is an illustration of the process cartridge of FIG. 9 when it is loaded with a developer supply container.

Referring to FIG. 9 and 10, the description will be made as to embodiment 3 of a process cartridge and a toner supply container. The structures of the process cartridge 5*b* and toner supply container of this embodiment are the same as in FIG. 1, and therefore, the different portion only will be described.

In this embodiment, curved guide portions 6*d* are provided on a rear side and front side inside surface of the toner container frame as guiding means for the toner container 3*a* when it is mounted downwardly through the opening 3*b* formed in the top surface of the toner container in the direction of the arrow after the toner container cap 3*c* of the toner supply container 38 is opened. The groove 6*b* of the developing container 8 in embodiment 1 and 2 are omitted in this embodiment.

The toner supply container 38 is provided with a sector-shape section as described in embodiment 2, and when the supply container 38 is mounted, the arcuated portion (section) of the supply container 38 slides along the guide portion 6*d* so that the opening 38*b* faces down as shown in FIG. 10 when it is loaded. The toner supply container 38 in this embodiment does not have an engaging portion 13 as in embodiment 1 and 2.

When the supplied toner in the toner supply container 38 is consumed, the subsequent fresh toner supply container is overlaid and pushed in substantially similarly to embodiment 2. By doing so, the used toner supply container 38 is compressed, and the fresh toner supply container is mounted along the guides portion 6*d*. The structure for the compression of the toner supply container 38 is similar to that described in the foregoing, and the seal 34 is removed in the same process to permit the toner supply.

Similarly to the foregoing embodiments, by mounting a plurality of toner supply containers, the toner can be supplied as desired as long as the lifetimes of the parts of the process cartridge do not end.

The guide 6*d* mechanism may be constituted by concave or recessed configuration on the surface of the development frame side and convex or recessed configuration in the supply container or by convex or recessed configuration in the development frame concave or recessed configuration in the supply container Embodiment 4

Figure 12:
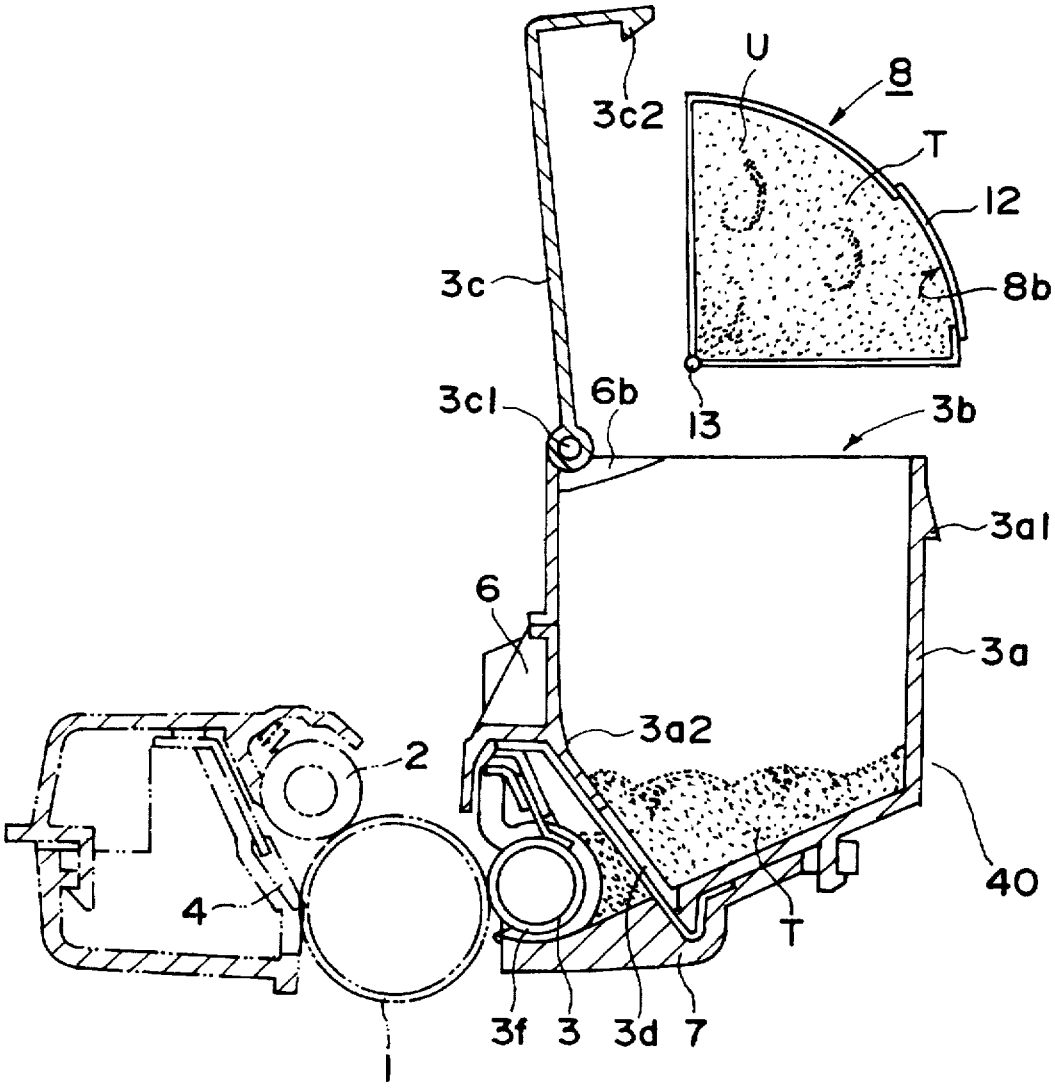
FIG. 12 is an illustration of a process cartridge and developer supply container according to embodiment 4.

FIG. 12 shows a developing device in the form of a cartridge in another embodiment.

The developing device 40 of this embodiment comprises a developing sleeve *3f*, and a toner accommodating portion accommodating toner T to supply the toner to the developing sleeve *3f*. They are unified into a cartridge by a frame of plastic resin material. The structure and function of the toner accommodating container *3a* and the toner supply container 8 are similar to the embodiment 1. The same reference numerals as in embodiment 1 are assigned to the elements having the corresponding functions, and detailed descriptions thereof are omitted for simplicity. The members and parts constituting the process cartridge are indicated by chain lines.

Embodiment 5

Figure 13:
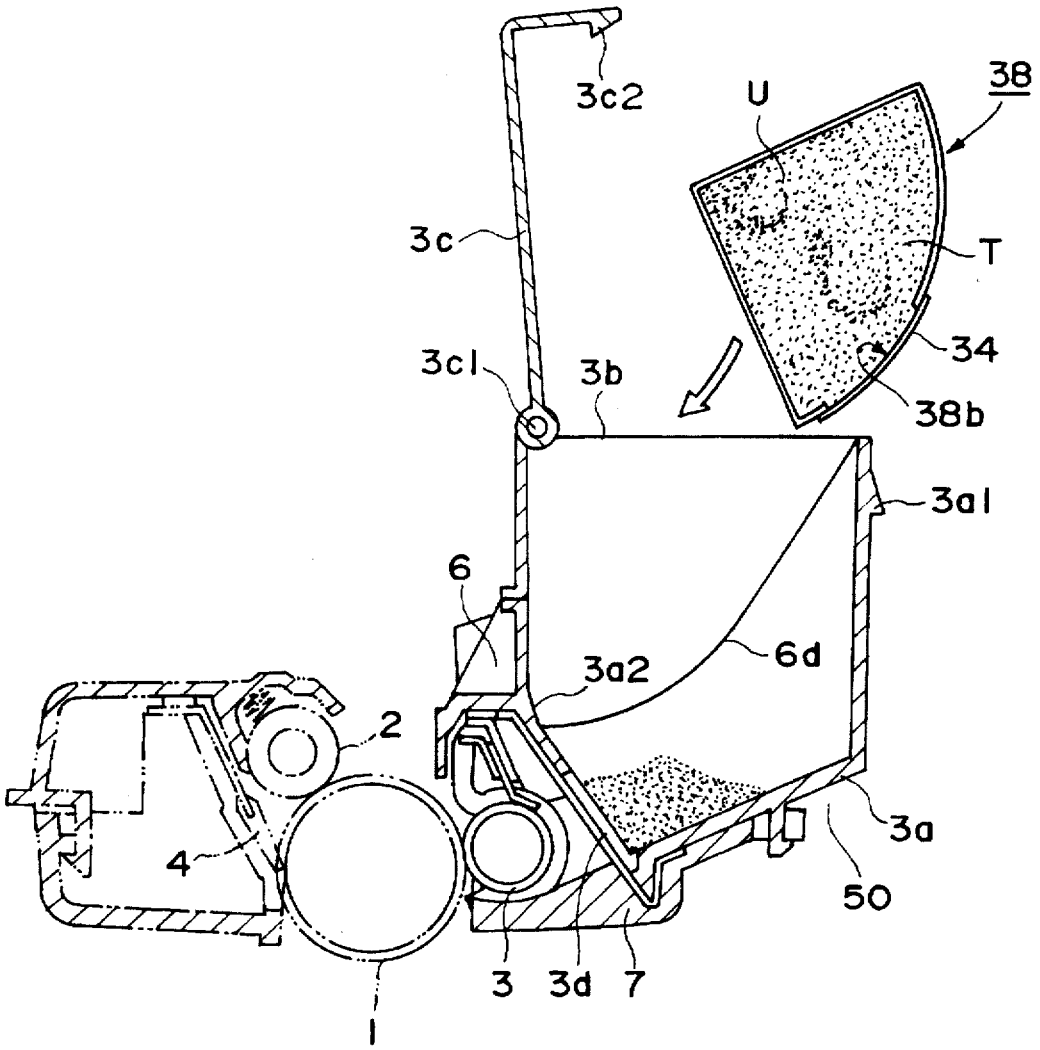
FIG. 13 is an illustration of a process cartridge and a developer supply container according to embodiment 5.

FIG. 13 shows a developing device 50 in the form of a cartridge according to a further embodiment of the present invention. The developing device 50 of this embodiment is similar to that of Embodiment 4, and the detailed description thereof is omitted.

The embodiments are summarized as follows.

A toner supply container (toner supply container 8, 18, 28, 38) for supplying toner into a toner container *3a* for accommodating the toner T usable for developing a latent image formed on an electrophotographic photosensitive member (photosensitive drum 1), wherein said toner accommodating container is detachably mountable relative to a main assembly 100*a* of an electrophotographic image forming apparatus, comprising:

A guide portion (engaging portion, 13 engaging portions 23, 33) for guiding the toner supply container into said toner accommodating container with engagement with said toner accommodating container;

A first portion (wall surface 8*r*) and a second portion (wall surface 8R) which are opposed to each other;

A third portion (wall surface 8E) connecting one longitudinal end of said first portion and second portion, wherein the third portion are foldable;

A fourth portion (wall surface 8E) connecting the other longitudinal ends of said first portion and second portion, wherein the fourth portion are foldable;

A toner supply opening (opening 8*b*), provided along a longitudinal direction between the first portion and the second portion, for supplying into said toner accommodating container the toner accommodated in the toner accommodation portion U structured by said first portion, second portion, third portion and fourth portion;

A sealing member (seal 12, 21, 32, 34) for openably sealing said toner supply opening;

Wherein a volume of said toner accommodation portion is reduced in a direction crossing with a longitudinal direction of said first portion and said second portion by the folding of said third portion and said fourth portion.

A process cartridge detachably mountable relative to a main assembly 100*a* of an electrophotographic image forming apparatus, wherein said process cartridge 5, 5*a* or 5*b* can be supplied with toner by a toner supply container (toner supply container 8, 18, 28, 38), said process cartridge comprising:

An electrophotographic photosensitive member (photosensitive drum 1);

Process means actable on said electrophotographic photosensitive member (charging means 2, developing means 3, cleaning means 9);

A toner accommodating container (toner container *3a*) for accommodating toner for developing a latent image formed on said electrophotographic photosensitive member;

An accommodation container opening (opening *3b*), formed in said toner accommodating container, for mounting said toner supply container (toner supply container 8, 18, 28, 38) into said toner accommodating container;

An openable cover (toner container cap 3c) for openably closing said accommodation container opening;

A cartridge guide (groove 6*b* guide portion 6*d*), in said toner accommodating container, for guiding said toner supply container;

A internal wall *3a2*, in said toner accommodating container, for keeping said toner supply container having a toner accommodation portion U, a volume of which is reduced in a direction crossing with its longitudinal direction.

A toner supply method for supplying toner into a toner accommodating container for accommodating the toner usable for developing a latent image formed on an electrophotographic photosensitive member (photosensitive drum 1) comprising the steps of;

Supplying the toner into said toner accommodating container from said toner supply container by mounting to said toner accommodating container said toner supply container (toner supply container 8, 18, 28, 38) containing the toner;

Compressing said toner supply container in a direction crossing with its longitudinal direction without removing said toner supply container; and Supplying the toner into said toner accommodating container from a fresh toner accommodating container by mounting a fresh toner supply container to said toner accommodating container.

As will be understood from the foregoing, according to these embodiments, there is provided a toner supply type process cartridge, developing device and a toner supply container wherein toner can be supplied without scattering the toner and without requiring a large space when the toner supply container is mounted to the process cartridge or to the developing device.

According to these embodiments, there is provided a toner supply type process cartridge, developing device and toner supply container wherein a plurality of toner supply containers can be mounted sequentially to a process cartridge or developing device.

As described in the foregoing, according to the present invention, after the toner is supplied into the toner accommodating container, there is no need of taking the toner supply container out of the toner accommodating container, so that the scattering of the toner can be minimized. Furthermore, the volume of the toner accommodation portion of the toner supply container can be reduced in a direction crossing with the longitudinal direction thereof, so that the thickness can be reduced as compared with the volume reduction in the longitudinal direction.

While the invention has been described with reference to the structures disclosed herein, it is not confined to the details set forth and this application is intended to cover such modifications or changes as may come within the purposes of the improvements or the scope of the following claims.

What is claimed is:

1. A toner supply container for supplying toner into a toner accommodating container for accommodating the toner usable for developing a latent image formed on an electrophotographic photosensitive member, wherein said toner accommodating container is detachably mountable relative to a main assembly of an electrophotographic image forming apparatus, comprising:

a guide portion for guiding the toner supply container into said toner accommodating container with engagement with said toner accommodating container;

a first portion and a second portion which are opposed to each other;

a third portion connecting one longitudinal end of said first portion and second portion, wherein the third portion is foldable;

a fourth portion connecting the other longitudinal end of said first portion and second portion, wherein the fourth portion is foldable;

a toner supply opening, provided along a longitudinal direction between the first portion and the second portion, for supplying into said toner accommodating container having a toner accommodation portion, the toner accommodated in the toner accommodation portion structured by said first portion, second portion, third portion and fourth portion;

a sealing member for openably sealing said toner supply opening;

wherein a volume of said toner accommodation portion is reduced in a direction crossing with a longitudinal direction of said first portion and said second portion by the folding of said third portion and said fourth portion.

2. A toner supply container according to claim 1, wherein said toner supply container has a substantially triangular column.

3. A toner supply container according to claim 1, wherein said toner supply container has an engaging portion for engaging with a curved guide in said toner accommodating container when the toner supply container is mounted to said toner accommodating container.

4. A toner supply container according to claim 1, wherein said toner supply container has a substantially sector cross-section, and the toner supply opening extends along a longitudinal direction thereof in a circular portion of the cross-section.

5. A toner supply container according to claim 1, wherein said third and fourth portions are provided with thin portions constituting foldable portions.

6. A toner supply container according to claim 1, wherein said toner supply container remains in said toner accommodating container in a compressed state after the toner is supplied to said toner accommodating container.

7. A toner supply container according to claim 1 or 4, wherein said sealing member is in the form of a thin film having a such a length that it extends out of said toner supply container when said toner supply container is mounted to said toner accommodating container.

8. A toner supply container according to claim 1, wherein said toner supply container is provided in a process cartridge which contains as an unit an electrophotographic photosensitive member, process means actable on said photosensitive member, and which is detachably mountable to a main assembly of the image forming apparatus.

9. A toner supply container according to claim 1, 2, 3, 4, 5 or 6, wherein said toner supply container is of plastic resin material integrally molded.

10. A toner supply container according to claim 8, wherein said container is of paper.

11. A toner supply container according to claim 1, wherein said toner supply container is substantially rotated and mounted into said toner accommodating container, and a toner containing portion of said toner supply container is reduced in said mounting direction.

12. A toner supply method for supplying toner from a toner supply container into a toner accommodating container for accommodating the toner usable for developing a latent image formed on an electrophotographic photosensitive member comprising the steps of;

supplying the toner into said toner accommodating container from said toner supply container by mounting to said toner accommodating container said toner supply container containing the toner;

compressing said toner supply container in a direction crossing with its longitudinal direction without removing said toner supply container; and supplying the toner into said toner accommodating container from a fresh toner supply container by mounting a fresh toner supply container to said toner accommodating container.

13. A method according to claim 12, wherein when said toner supply container is mounted to said toner accommodating container, said toner supply container is received by a space provided by consumption of the toner in said toner supply container.

14. A method according to claim 12 or 13, wherein said toner supply container is inserted into said toner accommodating container through an opening which opens upwardly and along a curved path in said toner accommodating container.

15. A method according to claim 12 or or 13, wherein when a fresh toner supply container is mounted into said toner accommodating container, said toner supply container already accommodated in said toner accommodating container is compressed by the fresh toner container, and wherein the fresh toner supply container is accommodated in said toner accommodating container in a space provided by the compression.

16. A method according to claim 12, wherein said compressing step compresses said toner supply container already accommodated in said toner accommodating container by the fresh toner supply container.

17. A method according to claim 12, wherein said supplying step is carried out by pulling, while said toner supply container is accommodated in said toner accommodating container, a toner seal extending out of said toner accommodating container to open a supply opening of said toner supply container.

18. A method according to claim 12, wherein upon mounting of said toner supply container to said toner accommodating container, a cover of said toner accommodating container at its top is opened, and then said toner supply container is mounted in said toner accommodating container, and thereafter, the cover is closed.

19. A method according to claim 12, wherein said toner accommodating container is provided in a process cartridge which has as a unit a photosensitive member and process means actable on said photosensitive member and which is detachably mountable to a main assembly of an image forming apparatus, wherein said process cartridge is supplied with the toner from said toner supply container.

20. A method according to claim 14, wherein when a fresh toner supply container is mounted into said toner accommodating container, the toner supply container already accommodated in said toner accommodating container is compressed by the fresh toner container, and wherein the fresh toner supply container is accommodated in said toner accommodating container in a space provided by the compression.

21. A method according to claim 12, wherein said toner supply container is substantially rotated and mounted into said toner accommodating container, and a toner containing portion of said toner supply container is reduced in said mounting direction.

22. A toner supply container for supplying toner into a process cartridge which has an electrophotographic photosensitive member and process means actable thereon and a toner accommodating container for accommodating the toner usable for developing a latent image formed on the electrophotographic photosensitive member, and which is detachably mountable relative to a main assembly of an electrophotographic image forming apparatus, comprising:

a guide portion for guiding the toner supply container into said toner accommodating container with engagement with said toner accommodating container;

a first portion and a second portion which are opposed to each other;

a third portion connecting one longitudinal end of said first portion and second portion, wherein the third portion is foldable;

a fourth portion connecting the other longitudinal end of said first portion and second portion, wherein the fourth portion is foldable;

a toner supply opening, provided along a longitudinal direction between the first portion and the second portion, for supplying into said toner accommodating container the toner accommodated in the toner accommodation portion structured by said first portion, second portion, third portion and fourth portion;

a sealing member for openably sealing said toner supply opening, wherein said sealing member has such a length to extend out of said toner accommodating container when said toner supply container is mounted in said toner accommodating container;

wherein a volume of said toner accommodation portion is reduced in a direction crossing with a longitudinal direction of said first portion and said second portion by the folding of said third portion and said fourth portion, and said first, second, third and fourth portions are integrally molded with a plastic resin material.

23. A toner supply container according to claim 22, wherein said toner supply container has a substantially triangular column.

24. A toner supply container according to claim 22, wherein said toner supply container has an engaging portion for engaging with a curved guide in said toner accommodating container when the toner supply container to said toner accommodating container is mounted.

25. A toner supply container according to claim 22, wherein said toner supply container has a substantially sector crosssection, and has the toner supply opening extends along a longitudinal direction thereof in a circular portion of the cross-section.

26. A toner supply container according to claim 22, wherein said third and fourth portions are provided with thin portions constituting foldable portions.

27. A toner supply container according to claim 22, wherein said toner supply container remains in said toner accommodating container in a compressed state after the toner is supplied to said toner accommodating container.

28. A toner supply container according to claim 22, wherein said process means includes a charging member for charging said photosensitive member.

29. A toner supply container according to claim 22, wherein said process means includes a developing roller for developing the latent image with the toner accommodated in said toner accommodating container.

30. A toner supply container according to claim 22, wherein said process means includes cleaning means for cleaning the toner remaining on said photosensitive member.

31. A toner supply container according to claim 22, wherein said toner supply container is substantially rotated and mounted into said toner accommodating container, and a toner containing portion of said toner supply container is reduced in said mounting direction.

32. A toner supply method for supplying toner rom a toner supply container into a process cartridge which has an electrophotographic photosensitive member and process means actable thereon and a toner accommodating container for accommodating the toner usable for developing a latent image formed on the electrophotographic photosensitive member, and which is detachably mountable relative to a main assembly of an electrophotographic image forming apparatus, comprising the steps of:

opening a cover of said toner accommodating container, said opening opens upwardly;

mounting said toner supply container in said toner accommodating container through said opening;

closing said cover to close said opening;

supplying the toner into said toner accommodating container from said toner supply container by pulling, while said toner supply container is in said toner accommodating container, a toner seal extended outside said toner accommodating container to open a supply opening of said toner supply container;

opening said cover;

compressing said toner supply container in a direction crossing with its longitudinal direction without removing said toner supply container; and mounting a fresh toner supply container through said opening into a space provided by said compressing step in said toner accommodating container;

closing said cover;

supplying the toner into said toner accommodating container from said toner supply container by pulling, while said toner supply container is in said toner accommodating container, a toner seal extended outside said toner accommodating container to open a supply opening of said toner supply container.

33. A method according to claim 32, wherein when said toner supply container is mounted to said toner accommodating container, said toner supply container is received by a space provided by consumption of the toner in said toner supply container.

34. A method according to claim 32 or 33, wherein said toner supply container is inserted into said toner accommodating container through an opening which opens upwardly and along a curved path in said toner accommodating container.

35. A method according to claim 32 or 33, wherein said compressing step compresses said toner supply container already accommodated in said toner accommodating container by the- fresh toner supply container.

36. A method according to claim 22, wherein said toner supply container is substantially rotated and mounted into said toner accommodating container, and a toner containing portion of said toner supply container is reduced in said mounting direction.

37. A process cartridge detachably mountable relative to a main assembly of an electrophotographic image forming apparatus, wherein said process cartridge can be supplied with toner by a toner supply container, said process cartridge comprising:

an electrophotographic photosensitive member;

process means actable on said electrophotographic photosensitive member;

a toner accommodating container for accommodating toner for developing a latent image formed on said electrophotographic photosensitive member;

an accommodation container opening, formed in said toner accommodating container, for mounting said toner supply container into said toner accommodating container;

an openable cover for openably closing said accommodation container opening;

a cartridge guide, in said toner accommodating container, for guiding said toner supply container;

a keeping portion, in said toner accommodating container, for keeping said toner supply container having a toner accommodation portion U, a volume of which is reduced in a direction crossing with its longitudinal direction.

38. A process cartridge according to claim 37, wherein said toner supply container comprises:

a guide portion, engageable with a cartridge guide of said toner accommodating container, for guiding the toner supply container into said toner accommodating container with engagement with said toner accommodating container;

a first portion and a second portion which are opposed to each other;

a third portion connecting one longitudinal ends of said first portion and second portion, wherein the third portion is foldable;

a fourth portion connecting the other longitudinal ends of said first portion and second portion, wherein the fourth portion is foldable;

a toner supply opening, provided along a longitudinal direction between the first portion and the second portion, for supplying into said toner accommodating container having a toner accommodating portion, the toner accommodated in the toner accommodation portion structured by said first portion, second portion, third portion and fourth portion;

a sealing member for openably sealing said toner supply opening;

wherein a volume of said toner accommodation portion is reduced in a direction crossing with a longitudinal direction of said first portion and said second portion by the folding of said third portion and said fourth portion.

39. A process cartridge according to claim 37, wherein said opening of said toner accommodating container opens upwardly.

40. A process cartridge according to claim 37 or 39, wherein said cartridge guide is curved to guide said toner supply container inclined-downwardly.

41. A process cartridge according to claim 37 or 39, wherein said process cartridge permits an end of said sealing member outside said process cartridge when said toner supply container is accommodated in said toner accommodating container.

42. A process cartridge according to claim 41, wherein said process cartridge permits an end of said sealing member outside said process cartridge by an opening, when said toner supply container is accommodated in said toner accommodating container.

43. A process cartridge according to claim 37, wherein a plurality of toner supply containers having volumes reduced in a direction crossing with a longitudinal direction are kept in said keeping portion.

44. A process cartridge according to claim 37, wherein said process means includes a charging member for charging said photosensitive member.

45. A process cartridge according to claim 37, wherein said process means includes a developing roller for developing the latent image with the toner accommodated in said toner accommodating container.

46. A porcess cartridge according to claim 37, wherein said process means includes cleaning means for cleaning the toner remaining on said photosensitive member.

47. A process cartridge according to claim 40, wherein said process cartridge permits an end of said sealing member outside said process cartridge when said toner supply container is accommodated in said toner accommodating container.

48. A process cartridge according to claim 47, wherein said process cartridge permits an end of said sealing member outside said process cartridge by an opening, when said toner supply container is accommodated in said toner accommodating container.

49. A process cartridge according to claim 37, wherein said toner supply container is substantially rotated and mounted into said toner accommodating container, and a toner containing portion of said toner supply container is reduced in said mounting direction.

50. A process cartridge detachably mountable relative to a main assembly of an electrophotographic image forming apparatus, wherein said process cartridge can be supplied with toner by a toner supply container, said process cartridge comprising:

an electrophotographic photosensitive member;

a charging member for charging said photosensitive member;

a developing roller for developing a latent image on said photosensitive member;

a toner accommodating container for accommodating toner for developing a latent image formed on said electrophotographic photosensitive member with said developing roller;

an accommodation container opening, formed in said toner accommodating container, for mounting said toner supply container into said toner accommodating container, wherein said opening opens upwardly;

an openable cover for openably closing said accommodation container opening;

a cartridge guide, in said toner accommodating container, for guiding said toner supply container, wherein said cartridge guide is curved to guide said toner supply container inclined-downwardly;

a keeping portion, in said toner accommodating container, for keeping said toner supply container having a toner accommodation portion, a volume of which is reduced in a direction crossing with its longitudinal direction.

51. A process cartridge according to claim 50, wherein said toner supply container is substantially rotated and mounted into said toner accommodating container, and a toner containing portion of said toner supply container is reduced in said mounting direction.

52. A process cartridge detachably mountable relative to a main assembly of an electrophotographic image forming apparatus, wherein said process cartridge can be supplied with toner by a toner supply container, said process cartridge comprising:

an electrophotographic photosensitive member;

a charging member for charging said photosensitive member;

a developing roller for developing a latent image on said photosensitive member;

a toner accommodating container for accommodating toner for developing a latent image formed on said electrophotographic photosensitive member with said developing roller;

an accommodation container opening, formed in said toner accommodating container, for mounting said toner supply container into said toner accommodating container, wherein said opening opens upwardly;

an openable cover for openably closing said accommodation container opening;

a cartridge guide, in said toner accommodating container, for guiding said toner supply container, wherein said cartridge guide is curved to guide said toner supply container inclined-downwardly;

a keeping portion, in said toner accommodating container, for keeping said toner supply container having a toner accommodation portion, a volume of which is reduced in a direction crossing with its longitudinal direction, wherein said keeping portion is capable of keeping a plurality of toner supply containers having a volume reduced in a direction crossing with a longitudinal direction;

wherein said toner supply container comprises:

a guide portion, engageable with the cartridge guide of said toner accommodating container, for guiding the toner supply container into said toner accommodating container with engagement with said toner accommodating container;

a first portion and a second portion which are opposed to each other;

a third portion connecting one longitudinal end of said first portion and second portion, wherein the third portion is foldable;

a fourth portion connecting the other longitudinal ends of said first portion and second portion, wherein the fourth portion is foldable;

a toner supply opening, provided along the longitudinal direction between the first portion and the second portion, for supplying into said toner accommodating container the toner accommodated in the toner accommodation portion U structured by said first portion, second portion, third portion and fourth portion;

a sealing member for openably sealing said toner supply opening;

wherein a volume of said toner accommodation portion is reduced in a direction crossing with the longitudinal direction of said first portion and said second portion by the folding of said third portion and said fourth portion.

53. A process cartridge according to claim 52, wherein said toner supply container is substantially rotated and mounted into said toner accommodating container, and a toner containing portion of said toner supply container is reduced in said mounting direction.

54. A toner supply container for supplying toner into a toner accommodating container for accommodating the toner usable for developing a latent image formed on an electrophotographic photosensitive member, wherein said toner accommodating container is detachably mountable relative to a main assembly of an electrophotographic image forming apparatus, the improvement residing in that:

a toner containing portion of said toner supply container has a volume which is reducible in a direction crossing with its longitudinal directions said toner supply container is substantially rotated and mounted into said accommodating container, and said toner containing portion is reduced in said mounting direction.

55. A toner supply method for supplying toner from a toner supply container into a toner accommodating container for accommodating the toner usable for developing a latent image formed on an electrophotographic photosensitive member, the improvement residing in that:

a toner containing portion of said toner supply container has a volume which is reducible in a direction crossing with its longitudinal directions said toner supply container is substantially rotated and mounted into said accommodating container, and said toner containing portion is reduced in said mounting direction.

56. A process cartridge detachably mountable to a main assembly of an image forming apparatus, comprising:

an electrophotographic photosensitive member;

process means actable on said photosensitive member;

a keeping portion for keeping a toner supply container in a toner accommodating container, wherein a toner containing portion of said toner supply container has a volume reduced in a direction crossing with a longitudinal direction of the toner accommodating container; said toner supply container is substantially rotated and mounted into said accommodating container, and said toner containing portion is reduced in said mounting direction.

* * * * *

UNITED STATES PATENT AND TRADEMARK OFFICE

CERTIFICATE OF CORRECTION

PATENT NO. : 5,761,584

DATED : June 2, 1998

INVENTORS : TADAYUKI TSUDA, ET AL.

It is certified that error appears in the above-identified patent and that said Letters Patent is hereby corrected as shown below:

COVER ITEM [56] RC,
Line Foreign Priority Documents, "01241567" should read --01-241567--, "04042179" should read --04-042179--, and "2186375" should read --2-186375--.

COVER ITEM [73],
ASSIGNMENT, "Canon Kabushiki Kaisha, Japan" should read --Canon Kabushiki Kaisha, Tokyo, Japan--.

COLUMN 1,
Line 37, "by" should read --by the--.

COLUMN 2,
Line 45, "EMBODIMENT" should read --EMBODIMENTS--.

COLUMN 3,
Line 4, "a" (first occurrence) should be deleted;
Line 32, "to" should be deleted;
Line 50, "drumlike" should read --drum-like--;
Line 53, "include," should read --includes,--; and
Line 62, "a" (first occurrence) should be deleted.

COLUMN 4,
Line 25, "the" (first occurrence) should be deleted; and
Line 38, close up left margin.

UNITED STATES PATENT AND TRADEMARK OFFICE

CERTIFICATE OF CORRECTION

PATENT NO. : 5,761,584

DATED : June 2, 1998

INVENTORS : TADAYUKI TSUDA, ET AL.

It is certified that error appears in the above-identified patent and that said Letters Patent is hereby corrected as shown below:

COLUMN 5,
Line 25, "caused" should read --caused to--; and
Line 66, "using" should read --use--.

COLUMN 6,
Line 27, "since the" should read --since--;
Line 30, "FIG." should read --FIGS.--;
Line 43, "embodiment" should read --embodiments--; and
Line 52, "embodiment" should read --embodiments--.

COLUMN 7,
Line 4, "container" should read --container.--;
Line 23, "Embodiment 4" should read --embodiment 4--;
Line 41, "are" should read --is--;
Line 44, "are" should read --is--;
Line 50, "portion;" should read --portion; and--;
Line 52, "opening;" should read --opening,--;
Line 59, "cartridge" should read --cartridges--; and
Line 61, "container" should read --containers--.

COLUMN 8,
Line 6, "container 8," should read --containers 8,--;
Line 9, "(groove 6*b*" should read --(groove 6*b*;--;
Line 11, "container;" should read --container; and--;
Line 14, "portion *U*," should read --portion.--; and
Line 25, "container" should read --containers--.

UNITED STATES PATENT AND TRADEMARK OFFICE

CERTIFICATE OF CORRECTION

PATENT NO. : 5,761,584

DATED : June 2, 1998

INVENTORS : TADAYUKI TSUDA, ET AL.

It is certified that error appears in the above-identified patent and that said Letters Patent is hereby corrected as shown below:

COLUMN 9,

Line 17, "portion;" should read --portion; and--;
Line 20, "opening;" should read --opening,--; and
Line 47, "a" (first occurrence) should be deleted.

COLUMN 10,
Line 24, "12 or or 13," should read --12, 13, or 14--;
Line 28, "and" should be deleted: and COLUMN 11,
Line 25, "portion;" should read --portion; and--;
Line 30, "container;" should read --container,--;
Line 48, "crosssection," should read --cross-section--; and
Line 49, "extends" should read --extend--.

COLUMN 12,
Line 6, "rom" should read --from--;
Line 29, "container; and" should read --container;--;
Line 33, "cover;" should read --cover; and--;
Line 53, "the-" should read --the--; and
Line 54, "claim 22," should read --claim 32,--.

UNITED STATES PATENT AND TRADEMARK OFFICE

CERTIFICATE OF CORRECTION

PATENT NO. : 5,761,584

DATED : June 2, 1998

INVENTORS : TADAYUKI TSUDA, ET AL.

It is certified that error appears in the above-identified patent and that said Letters Patent is hereby corrected as shown below:

COLUMN 13,
Line 10, "container;" --container; and--;
Line 13, "portion *U*," should read --portion,--;
Line 25, "ends" should read --end--;
Line 28, "ends" should read --end--;
Line 37, "portion;" should read --portion; and--; and
Line 39, "opening;" should read --opening,--.

COLUMN 14,
Line 5, "porcess" should read --process--; and
Line 47, "inclined-downwardly;" should read --inclined-downwardly; and--.

COLUMN 15,
Line 14, "inclined-downwardly;" should read --inclined-downwardly; and--;
Line 22, "direction;" should read --direction,--;
Line 35, "ends" should read --end--;
Line 43, "portion *U*" should read --portion--;
Line 44, "portion;" should read --portion; and--; and
Line 46, "opening;" should read --opening,--.

UNITED STATES PATENT AND TRADEMARK OFFICE

CERTIFICATE OF CORRECTION

PATENT NO. : 5,761,584

DATED : June 2, 1998

INVENTORS : TADAYUKI TSUDA, ET AL.

It is certified that error appears in the above-identified patent and that said Letters Patent is hereby corrected as shown below:

COLUMN 16,
Line 17, "directions said" should read --direction; and ¶ said--;
Line 29, "directions said" should read --direction; and ¶ said--;
Line 42, "container;" should read --containers; and--; and
Line 43, "container: said" should read --container; and ¶ said--.

Signed and Sealed this

Twenty-fifth Day of May, 1999

*Attest:*

*Attesting Officer*

Q. TODD DICKINSON

*Acting Commissioner of Patents and Trademarks*